United States Patent [19]

Oh

[11] Patent Number: 4,918,276

[45] Date of Patent: Apr. 17, 1990

[54] AUTOMATIC COOKING CONTROL SYSTEM FOR A MICROWAVE OVEN

[75] Inventor: Ki T. Oh, Kyungsangnam, Rep. of Korea

[73] Assignee: Goldstar Co., Ltd., Seoul, Rep. of Korea

[21] Appl. No.: 287,025

[22] Filed: Dec. 21, 1988

[30] Foreign Application Priority Data

Dec. 22, 1987 [KR] Rep. of Korea ..... 14741/1987

[51] Int. Cl.[4] ..... H05B 6/68

[52] U.S. Cl. ..... 219/10.55 M; 219/10.55 B; 99/325

[58] Field of Search ..... 219/10.55 B, 10.55 K, 219/10.55 E, 10.55 M, 492, 400; 99/325, DIG. 14; 426/243

[56] References Cited

U.S. PATENT DOCUMENTS

| | | | |
|---|---|---|---|
| 4,115,678 | 9/1978 | Tachikawa et al. | 219/10.55 B |
| 4,162,381 | 7/1979 | Buck | 219/10.55 B |
| 4,812,606 | 3/1989 | Eke | 219/10.55 B |
| 4,831,227 | 5/1989 | Eke | 219/10.55 M |

*Primary Examiner*—Philip H. Leung

*Attorney, Agent, or Firm*—Birch, Stewart, Kolasch & Birch

[57] ABSTRACT

An automatic cooking control system for a microwave oven having a turntable utilizes an initial operation process which makes the air temperature of a heating chamber by uniformed only operating a fan. The automatic cooking control system further utilizes first stage heating operation process which actuates a magnetron after the initial operation process. The first stage process detects, an outflow air temperature, stores it as a present temperature, and obtains an arithmetical mean of the present temperature and a previous temperature detected prior to a half rotational period of the turntable. The first stage heating operation process is carried out until the arithmetical mean is raised as much as a predetermined value established according to the kind of food being cooked. The system also utilizes a second stage heating operation process which is carried out for a time period that is obtained by multiplying the first stage heating time by a predetermined value established by the kind of food being cooked. This system can automatically cook food with the correct heating time even though the outflow air temperature detected by a temperature sensor oscillates due to the rotation of the turntable.

6 Claims, 5 Drawing Sheets

FIG, 5
PRIOR ART
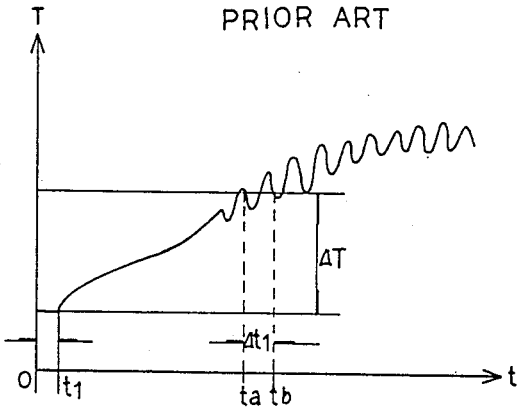
FIG, 6
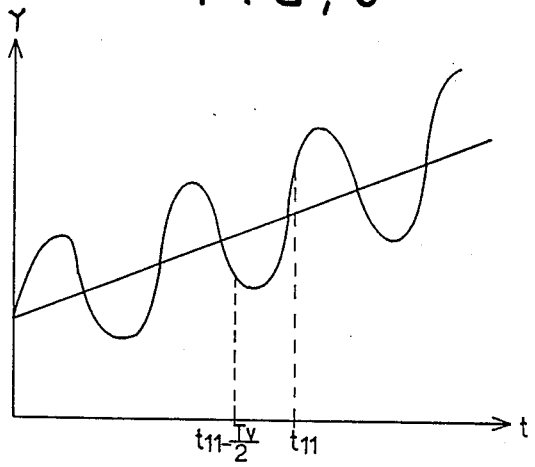

FIG, 7
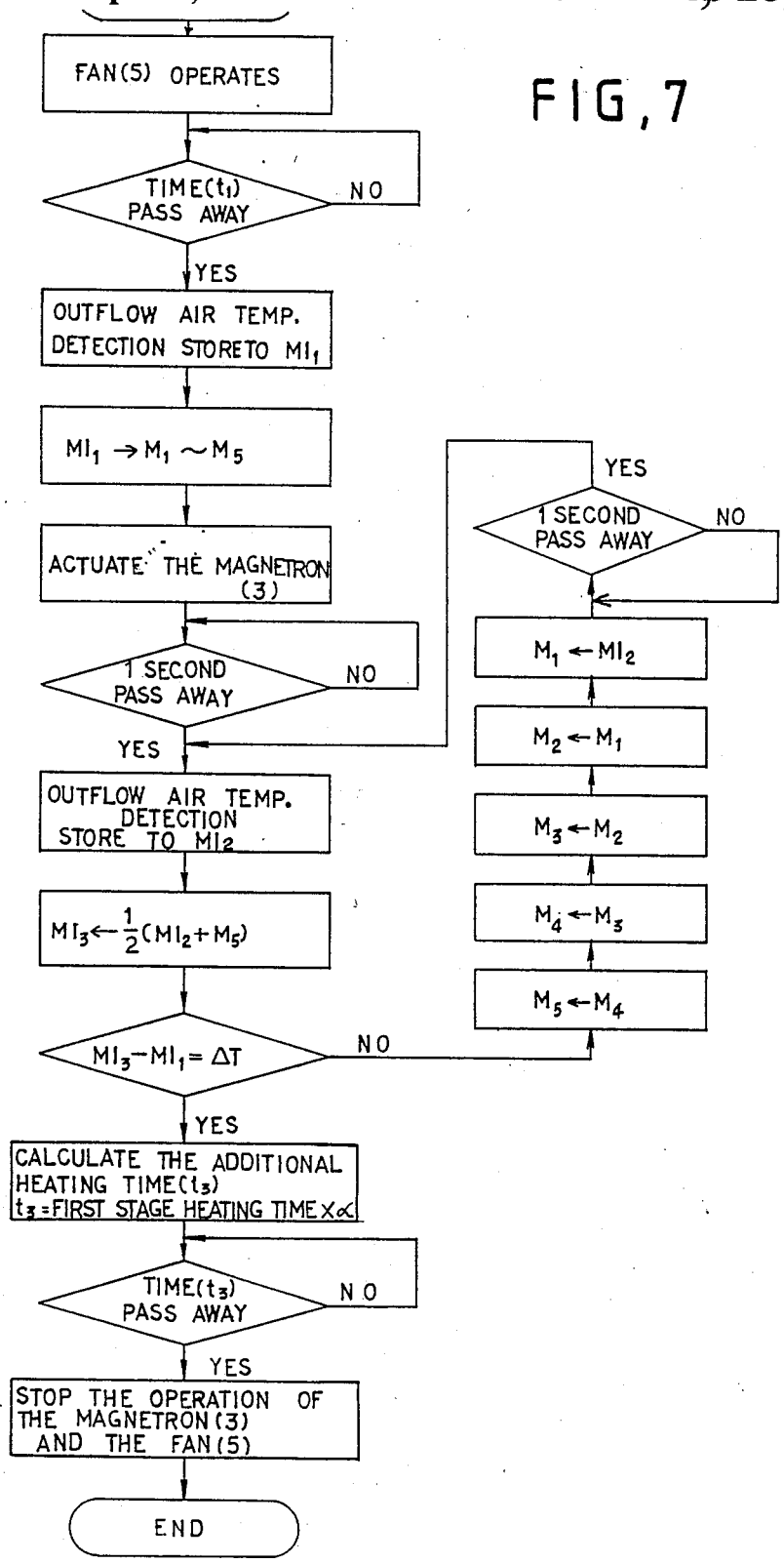

AUTOMATIC COOKING CONTROL SYSTEM FOR A MICROWAVE OVEN

BACKGROUND OF THE INVENTION

The present invention relates to an automatic cooking control system for a microwave oven with a turntable which can automatically cook food by utilizing a temperature sensor that detects the temperature of air flowing out of a heating chamber, and more particularly, to an automatic cooking control system which is able to automatically cook food by establishing a heating time of for the food to be cooked even though an outflow air temperature detected at the temperature sensor oscillates due to the rotation of the turntable.

In general, a microwave oven which cooks food automatically is constructed, as shown in FIG. 1, with a microcomputer 1 which controls the whole operation of a microwave oven, a power source 2 which supplies electric power under the control of the microcomputer 1, a magnetron 3 which generates microwave energy upon actuation by electric power from the power source 2, a heating chamber 4 which heats the food positioned on a turntable 4A with the microwave energy generated for the magnetron 3, a fan 5 which blows air through an air inlet 4B into the heating chamber 4, a temperature sensor 6 which detects the temperature of air flowing out through an air outlet 4C of the heating chamber 4, and an analog/digital converter 7 which converts the signal of outflow air temperature detected by the temperature sensor 6 into a digital signal and inputs the converted signal into the microcomputer 1.

With the conventional microwave oven constructed as described above, when a food to be cooked is put onto a turntable 4A of a heating chamber 4 and an automatic cooking is started by pressing a cooking start button, a microcomputer 1 begins to execute an initial operation for a predetermined time $t_1$ as shown in FIGS. 2 and 3. A fan 5 is actuated for about sixteen seconds to blow air through an air inlet 4B into the heating chamber 4 so that the air temperature of the heating chamber 4 can be made uniformed. The temperature of the air flowing out of the air outlet 4C is detected by a temperature sensor 6. The detected temperature signal is then converted into a digital signal by the analog/digital converter 7.

When a predetermined time $t_1$ has elapsed, the microcomputer 1 receives and stores the signal of the present temperature $T_1$ which is outputted from the analog/digital converter 7. The microcomputer 1 controls the actuation of the power source 2, The food positioned on the turntable 4A of the heating chamber 4 is heated by microwave energy generated by the magnetron 3. Since the temperature of air flowing out of the heating chamber 4 through the air outlet 4C is gradually raised according to the heating of food, the temperature detection signal, which is detected by the temperature sensor 6 and inputted to the microcomputer 1 through the analog/digital converter 7, is also gradually raised.

The temperature increment is raised as much as a predetermined value $\Delta T$. The temperature detected at the temperature sensor 6 is raised as much as a predetermined temperature $T_2$ so that when the temperature increment becomes a predetermined value $\Delta T$, microcomputer 1 finishes a first stage heating operation and starts to execute a second stage heating.

In summary, the conventional automatic cooking control is executed utilizing a method having the steps of: storing a time $t_2$ of a first stage heating; calculating a second stage heating time $t_3$ by multiplying the first stage heating time $t_2$ by a predetermined value $\alpha$ established in accordance with the kind of food to be cooked; heating the food by continuously actuating the magnetron 3 for the second stage heating time $t_3$; and completing the cooking of the food by stopping the actuation of magnetron 3 and fan 5 when the second stage heating time $t_3$ has elapsed.

In such an automatic cooking control method, since the geometrical center of the turntable 4A and the temperature-responsive center of the food to be cooked in the course of the rotation of the turntable 4A are not in precise accord with each other, the temperature characteristic of outflow air detected by the temperature sensor 6 oscillates.

FIG. 4 is a graph showing a temperature response characteristic of the outflow air when cooking egg custard comprising two eggs with two cups of milk. The temperature response characteristic of outflow air oscillates causing the first stage heating time to become short and the second stage heating time to become short, thereby causing the automatic cooking process; not to be correctly performed.

The outflow air temperature oscillates as shown in FIG. 5. The first stage heating process is finished at the time $t_a$, but not the desired time causing the first stage heating time to be shortened as much as a predetermined time $\Delta t_1$. Thus the second stage heating time also becomes short, thereby making it impossible to execute correctly the automatic cooking of food.

SUMMARY OF THE INVENTION

Therefore, the object of the present invention is to provide an automatic cooking control system which is able to correctly execute the automatic cooking of food by accurately determining a first stage heating time, even though the outflow air temperature flowing out of the heating chamber oscillates due to the rotation of a turntable. The above object of the present invention is realized by determining whether or not the first stage heating operation is finished. This determination is accomplished by obtaining an arithmetical mean of the outflow air temperatures detected at present and a predetermined time before.

BRIEF DESCRIPTION OF THE DRAWINGS

FIG. 5 is a graph illustrating the errors of first stage heating process according to the conventional automatic cooking control system;

FIG. 6 is a graph for explaining the automatic cooking control system of the present invention; and FIG. 7 is a flow chart of a microcomputer according to the automatic cooking control system of the present invention.

DETAILED DESCRIPTION OF THE INVENTION

Figure 1:
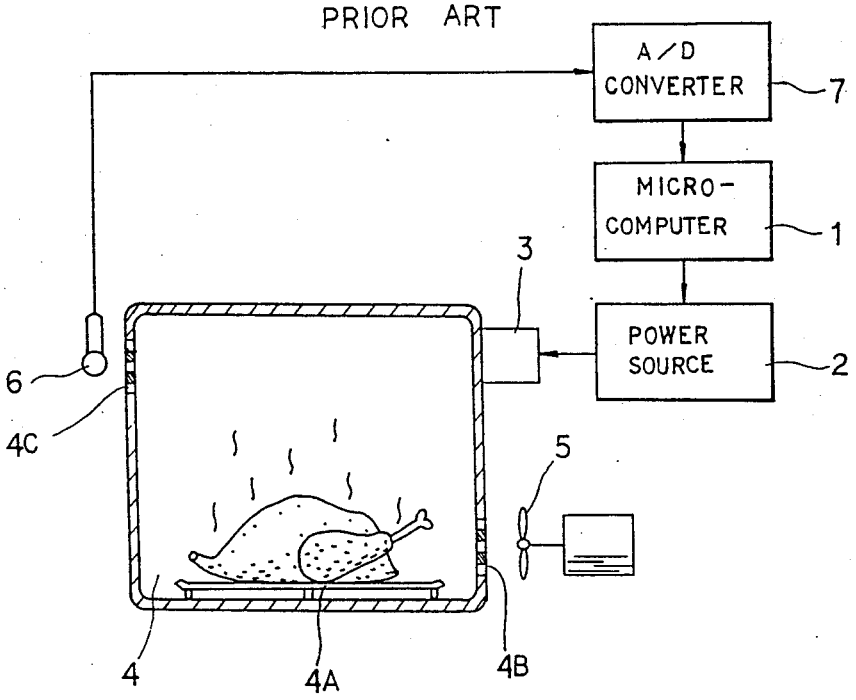
FIG. 1 PRIOR ART
FIG. 1 is a schematic diagram illustrating the configuration of a conventional microwave oven.
Figure 3:
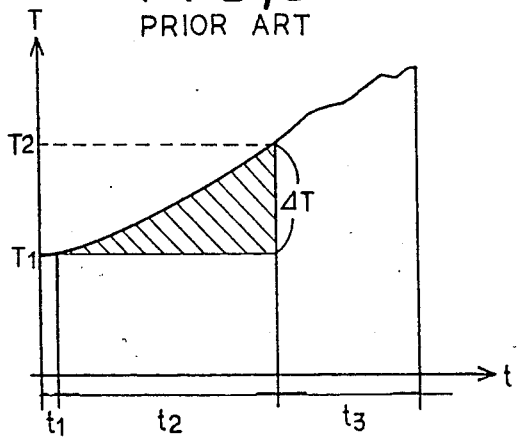
FIG. 3 PRIOR ART
FIG. 3 is a graph illustrating the change of outflow air temperature according to the conventional automatic cooking control system.
Figure 2:
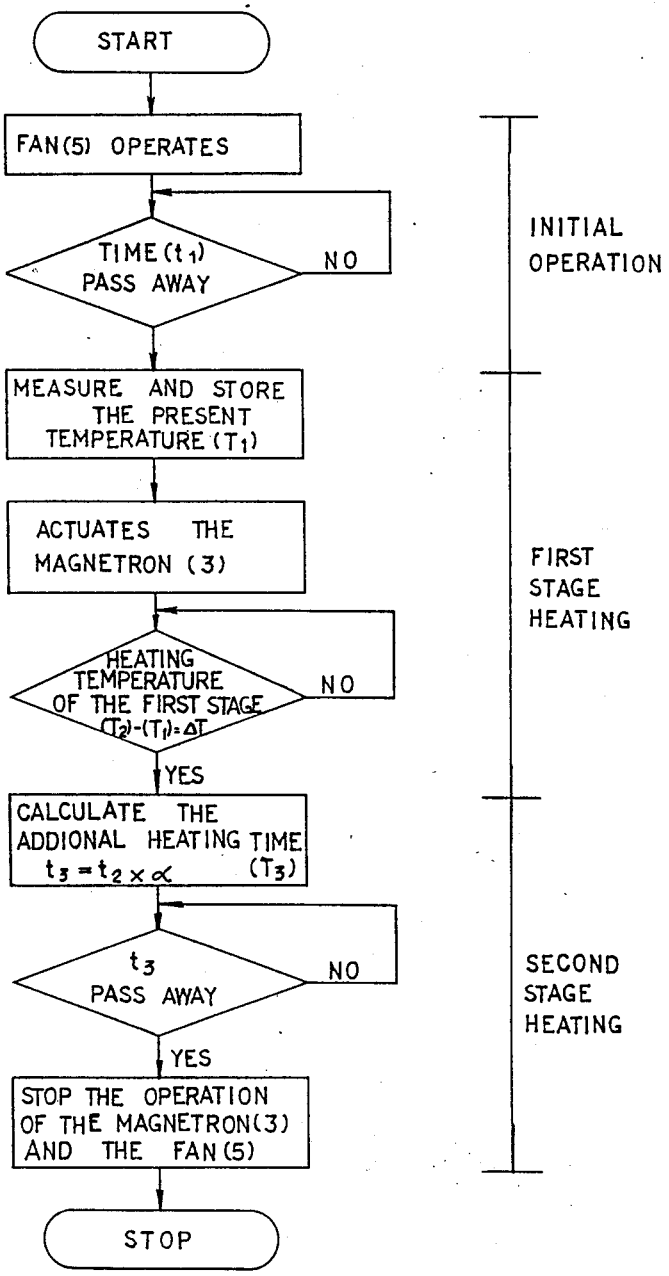
FIG. 2 PRIOR ART
FIG. 2 is a flow chart of a microcomputer according to a conventional automatic cooking control system.
Figure 4:
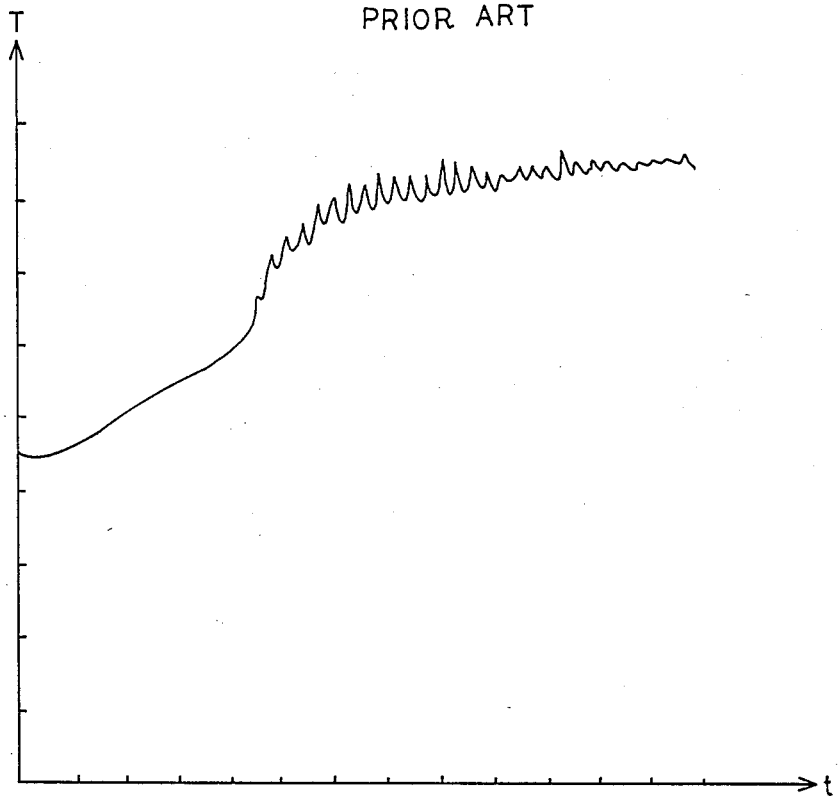
FIG. 4 PRIOR ART
FIG. 4 is a graph illustrating the temperature change characteristic of outflow air when automatic cooking of a food.

To begin with, the method for obtaining an arithmetical mean of the outflow air temperatures detected at present and a predetermined time before using the below, numerical formulas will be explained.

A temperature response which oscillates and has a constant period, can be represented by the following numerical expression:

$$y = k \cdot t + C + A \cdot \mathrm{Sin}\,\frac{2\pi}{T_V} \cdot t$$

Wherein,
y is a temperature,
k is a gradient,
t is a time,
C is a constant,
A is an amplitude, and
$T_V$ is a period.

Accordingly, the arithmetical mean for a temperature of an arbitrary point of time $t = t_{11}$ and a temperature of a point of time $$t = t_{11} - \frac{T_V}{2},$$

which is prior to the arbitrary point of time follows.

$$\begin{aligned}
\text{Arithmetical mean} &= \frac{1}{2}\left[y(t = t_{11}) + y\left(t = t_{11} - \frac{T_V}{2}\right)\right] \\
&= \frac{1}{2}\left[k \cdot t_{11} + C + A \cdot \mathrm{Sin}\,\frac{2\pi}{T_V} \cdot t_{11} + k \cdot \left(t_{11} - \frac{T_V}{2}\right) + C + A \cdot \mathrm{Sin}\,\frac{2\pi}{T_V} \cdot \left(t_{11} - \frac{T_V}{2}\right)\right] \\
&= \frac{1}{2}\left(k \cdot t_{11} + k \cdot \left(t_{11} - \frac{T_V}{2}\right)\right) + 2C + A \cdot \left[\mathrm{Sin}\,\frac{2\pi}{T_V} \cdot t_{11} + \mathrm{Sin}\,\frac{2\pi}{T_V}\left(t_{11} - \frac{T_V}{2}\right)\right] \\
&= \frac{1}{2}\left[k \cdot t_{11} + k \cdot \left(t_{11} - \frac{T_V}{2}\right)\right] + C \\
&= k \cdot t_{11} + C - \frac{1}{4} \cdot k \cdot T_V
\end{aligned}$$

As can be seen from the above formula, when the temperatures detected at the time $t_{11}$ and $$t_{11} - \frac{T_V}{2},$$

respectively, are summed up to determine the arithmetical mean, the oscillating portion is removed and the temperature becomes constant.

An error E compared with a normal condition is represented as follows;

$$\begin{aligned}
E &= k \cdot t_{11} + C - \text{arithmetical mean} \\
&= k \cdot t_1 + C - \left(k \cdot t_1 + C - \frac{1}{4} k \cdot T_V\right) \\
&= \frac{1}{4} \cdot k \cdot T_V
\end{aligned}$$

A temperature increasing rate of outflow air, a gradient k, is very slow; however, the rotational period of a turntable 4A, that is, the oscillation period $T_V$ of the temperature, is relatively quick. According the error E becomes small and substantially about 20% compared with an error according to an oscillation of temperature.

FIG. 7 is a signal flow chart of a the microcomputer 1 according to the automatic cooking control system of the present invention which executes a first stage heating by obtaining the above described arithmetical mean and a second stage heating. As shown in the drawing, when a user puts food to be cooked on a turntable 4A of a heating chamber 4, and a cooking operation is started by pressing a cooking start button, a the microcomputer 1 operates an initial operation as usual. The microcomputer 1 only actuates a fan 5 to make the air temperature within the heating chamber 4 uniformed, when a predetermined time $t_1$ has elapsed, the outflow air temperature is detected and stored in a memory $MI_1$. The outflow air temperature stored in the memory $MI_1$ is stored in memories $M_1$–$M_5$, a food is then heated upon actuation of magnetron 3.

After the actuation of the magnetron 3, the microcomputer 1 detects the outflow air temperature at a constant time interval, for example, 1 second interval, and stores it in a memory $MI_2$. The microcomputer 1 then computes the arithmetical mean of the temperatures stored in said memory $MI_2$ and a memory $M_5$ by a numerical formula $\frac{1}{2}(MI_2 + M_5)$ and stores the product in a memory $MI_3$.

Whether or not the outflow air temperature is raised as much as a predetermined value $\Delta T$ is determined by subtracting the value stored in a memory $MI_1$ from the temperature stored in the memory $MI_3$. If not, the temperatures stored in memories $M_4$–$M_1$ are shifted to memories $M_5$–$M_2$, respectively and stored therein. The present outflow air temperature stored in the memory $MI_2$ is then stored in the memory $M_1$. After one second has elapsed, the outflow air temperature is detected and stored in the memory $MI_2$, the arithmetical mean of the temperatures stored in the memory $MI_2$ and the memory $MI_5$ is again calculated. Thereafter, it is determined whether the outflow air temperature is raised as much as a predetermined value $\Delta T$. The above process is repeated until the outflow air temperature is raised as much as a predetermined value $\Delta T$.

Thus, when the outflow air temperature is raised as much as the value $\Delta T$, the first stage heating is completed. Then, the second stage heating time $t_3$ is calculated by multiplying the first stage heating time by a predetermined value $\alpha$ which is established in accordance with the kind of food being. The magnetron 3 is continuously actuated for the second stage heating time $t_3$ to heat a food. When the second stage heating time $t_3$ has elapsed, the cooking of food is finished by stopping the actuation of magnetron 3 and fan 5.

As described above, the present invention has the advantage that the automatic cooking food is very correctly performed by accurately determining the first stage heating time which is executed in a manner that by discriminating whether the outflow air temperature is raised as much as a predetermined value after obtaining an arithmetical mean of the outflow air temperatures detected at present and a predetermined time before.

What is claimed is:

1. A method of automatically cooking in a microwave oven having a heating chamber, a magnetron and a turntable comprising the steps of:

(a) measuring and storing a first temperature of air flowing out of the heating chamber;

(b) actuating the magnetron;

(c) measuring and storing a second temperature of the air flowing out of the heating chamber after a time delay of one second;

(d) calculating an arithmetic mean of the first and second temperature;

(e) determining if a difference between the first temperature and the arithmetic mean calculated in said step (d) is equal to a predetermined temperature increment, the amount of time between the actuation of the magnetron and the quality determined in said step (e) defining a first period of time;

(f) calculating an additional cooking time by multiplying the first period of time by a predetermined coefficient when said step (e) determines that the difference is equal to the predetermined temperature increment; and (g) actuating the magnetron for the additional cooking time.

2. The method as claimed in claim 1, further comprising the step of:

(h) actuating a fan of the microwave oven prior to executing said step (a).

3. The method as claimed in claim 1, further comprising the step of:

(h) repeating said steps (c), (d), and (e) when said step (e) determines that the difference is not equal to the predetermined temperature increment.

4. The method as claimed in claim 3, wherein said step (a) stores the first temperature in a memory of the microwave oven, the memory having five memory locations, the fifth memory location representing the first temperature.

5. The method as claimed in claim 4, wherein said step (h) comprises the steps of:

(i) shifting contents of each memory location up one location in the memory; and (j) storing the second temperature measured in said step (c) in the first memory location.

6. The method as claimed in claim 1, wherein said step (d) calculates the arithmetic mean by multiplying a gradient by a time and adding a constant to the product, a product calculated by multiplying the gradient by a quarter period of time is then subtracted from the sum thereby calculating the arithmetic mean.

* * * * *